US008596104B2

(12) United States Patent
Ziesel et al.

(10) Patent No.: US 8,596,104 B2
(45) Date of Patent: Dec. 3, 2013

(54) DEVICE AND METHOD FOR PRODUCING PROFILED BODIES

(75) Inventors: Norbert Ziesel, Waldburg (DE); Frank Beig, Bodnegg (DE)

(73) Assignee: Mueller Weingarten AG, Weingarten (DE)

( * ) Notice: Subject to any disclaimer, the term of this patent is extended or adjusted under 35 U.S.C. 154(b) by 927 days.

(21) Appl. No.: 12/274,432

(22) Filed: Nov. 20, 2008

(65) Prior Publication Data

US 2009/0126440 A1 May 21, 2009

Related U.S. Application Data

(63) Continuation of application No. PCT/DE2007/000556, filed on Mar. 27, 2007.

(30) Foreign Application Priority Data

May 26, 2006 (DE) ..... 10 2006 025 034

(51) Int. Cl.
*B21B 17/10* (2006.01)
*B21D 17/04* (2006.01)

(52) U.S. Cl.
USPC ..... 72/213; 72/208

(58) Field of Classification Search
USPC ..... 72/212, 213, 207–209, 67, 68, 82–85, 72/102, 105–107, 110, 111, 95, 96, 100, 72/370.2, 370.21, 31.06, 387, 415; 29/893.32, 893.34
See application file for complete search history.

(56) References Cited

U.S. PATENT DOCUMENTS

| | | | | | |
|---|---|---|---|---|---|
| 2,145,125 | A | * | 1/1939 | Moore | 72/206 |
| 3,591,136 | A | | 7/1971 | Bishop | |
| 3,729,970 | A | | 5/1973 | Propach et al. | |
| 3,763,688 | A | * | 10/1973 | Cuq | 72/402 |
| 4,178,790 | A | | 12/1979 | Buckley et al. | |
| 5,471,858 | A | * | 12/1995 | Deriaz | 72/83 |
| 5,794,475 | A | | 8/1998 | Schuppler et al. | |
| 5,829,297 | A | * | 11/1998 | Ohkubo | 72/213 |
| 5,862,700 | A | * | 1/1999 | Klein | 72/213 |
| 5,953,947 | A | * | 9/1999 | Klein | 72/213 |

FOREIGN PATENT DOCUMENTS

| | | | |
|---|---|---|---|
| DE | 20 17 709 | A1 | 11/1971 |
| DE | 20 65 191 | A1 | 12/1972 |
| DE | 195 06 391 | A1 | 9/1996 |
| DE | 195 31 907 | A1 | 3/1997 |
| DE | 196 39 081 | C2 | 4/1998 |
| EP | 0 006 137 | A1 | 1/1980 |
| EP | 0 099 256 | A1 | 1/1984 |
| EP | 0 177 334 | A2 | 4/1986 |
| EP | 0 728 540 | A2 | 8/1996 |
| FR | 2 281 180 | A2 | 3/1976 |

* cited by examiner

*Primary Examiner* — Debra Sullivan
(74) *Attorney, Agent, or Firm* — Burr & Brown

(57) ABSTRACT

The invention relates to a device and a method for producing longitudinal grooves in cylindrical workpieces, especially for producing longitudinal grooves having an irregular profile. The forming process is carried out by means of segmental wheels in a similar manner to that of a rolling method.

18 Claims, 5 Drawing Sheets

DEVICE AND METHOD FOR PRODUCING PROFILED BODIES

CROSS REFERENCE TO RELATED APPLICATIONS

This application is a continuation of International Application No. PCT/DE2007/000556, filed Mar. 27, 2007, which designated the United States, and claims the benefit under 35 USC §119(a)-(d) of German Application No. 10 2006 025 034.6, filed May 26, 2006, the entireties of which are incorporated herein by reference.

FIELD OF THE INVENTION

The invention relates to a device and a method for producing longitudinal grooves in cylindrical workpieces, in particular for producing longitudinal grooves having an irregular profile, the forming process being effected by means of segmental discs in a manner similar to that of a rolling method.

BACKGROUND OF THE INVENTION

In the production of profiled bodies such as, for example, disc carriers of clutches, toothed-belt discs or similar workpieces having a cylindrical basic structure, high levels of accuracy and precision are frequently required. In particular, accuracy and the surface quality are important.

Described in DE 20 17 709 is a method used for producing the above-mentioned components. A special rolling die enables the workpiece to be produced from a blank having a smooth outer contour by means of a press, each press stroke shaping a workpiece from a blank. Upon each press stroke, a rolling operation is executed, in which the profiled rollers impress the wanted external profile into the circumferential surface of the workpiece. The profiled rollers in this case are arranged in a bottom die along the circumference of the workpiece to be worked. If the workpiece is pressed between the rollers by means of a top die attached to the ram of the press, these rollers are supported on support rollers having a corresponding bearing system. The bottom die can be constructed to be rotationally symmetrical, the individual profiled rollers that produce the profile of the workpiece being distributed regularly and at a uniform angle in relation to each other along the circumference of the workpiece. As a consequence thereof, and owing to the resultant rotationally symmetrical apportioning of forces during a forming process, the individual grooves produced by the respective profiled rollers are practically the same as each other. In particular, an outer contour having no offset is achieved.

The disadvantage of this method is that the rotation, and therefore the rolling of the profiled rollers, is produced only by the forces acting between the workpiece and the profiled roller during the forming process. There occurs as a result non-definable slip of the profiled roller in relation to the workpiece. In the case of continuous profiles that are uniform in the longitudinal direction, this slip does not normally result in problems. If the profile is irregular in the longitudinal direction, however, for example having a web, in the middle of the profile length, extending transversely relative to the longitudinal groove, the slip results in dimensional inaccuracies, and thus in quality defects.

Disclosed in DE 195 06 391 A1 is a method in which the profiled rollers are driven in such a way that the circumferential speed in the forming region matches the speed of the workpiece. The drive is effected by transmission of the ram motion to the profiled rollers via transmission means, such as toothed racks and toothed wheels. This method, or the arrangement of the above-mentioned transmission means, reliably prevents the slip between the profiled rollers and the workpiece.

The disadvantage of this method is the very resource-intensive structure and the resultant high costs of the device. It is further disadvantageous that the multiplicity of transmission means necessitates a large structural height of the device.

A device for producing longitudinal grooves in a cylindrical workpiece is likewise described in EP 0 006 137 A1. In the case of this solution, the forming process is effected, not by profiled rollers, but by segmental discs. The segmental discs are not driven. The outer contours of the segmental discs roll on the surface of the downwardly-moving workpiece. As a result, the segmental discs move on a circular path curve. The positions of the segmental discs at the start of the engagement are defined by spring-actuated retaining pins. The segmental discs are connected to a housing by means of a spherical sliding bearing system. Since the segmental discs are moved exclusively by the forces acting during the forming process and do not have a drive synchronized with the ram motion, a slight slip between the segmental disc surface and the workpiece is unavoidable. In addition, a precisely defined starting position of the segmental discs for the forming process cannot be realized. This is a crucial disadvantage, especially for workpieces having grooved profiles that are irregular in the longitudinal direction.

SUMMARY OF THE INVENTION

The invention is based on the object of developing a method and a device for producing profiles in cylindrical workpieces, by means of a structurally simple and therefore inexpensive and functionally reliable die, with slip between the workpiece surface and the forming die elements being reliably prevented, and a high precision of the profile to be produced being achieved through a precisely defined starting point of the forming engagement.

The invention is based on the concept of executing the forming process in a manner similar to that of a method of forming by rolling, but with, driven segmental discs, rather than with profiled rollers, as the forming die element. The segmental discs are guided on slide surfaces, and are synchronized with the motion of the workpiece through a forced coupling to the punch, or bottom die part. This means that the segmental discs are not moved by the forces acting during the forming process, but by the motion of the punch. Accordingly, slip between the segmental discs and the workpiece during the forming process is thereby precluded. As already mentioned, the segmental discs are guided on slide surfaces. These slide surfaces are curved so as to enable the profiled segmental disc surfaces to roll on the workpiece. To enable the segmental discs to move along the curved slide surfaces, they are held and guided from beneath by the bottom die part, and from above by the top die part, or punch. Preferably the holding force is applied to the segmental discs by gas springs, which, in turn, are connected to the top die part. Other force transmitting means, such as, for example, springs, are also conceivable.

The segmental discs are held between the top die part, or components attached thereto, and the bottom die part at each instant of the forming process, and they therefore execute exactly the same vertical motion as the workpiece, which likewise is connected to the top die part, or to components attached thereto. The contact surfaces of the components that are connected to the segmental discs are so realized that the horizontal component of the segmental disc motion is taken up. Preferably, the surfaces are so designed that a substantially horizontal sliding motion between the segmental discs and the contacting components is rendered possible. This described device constitutes a structurally simple, and therefore also robust and inexpensive solution, but also one that is very precise and of high quality.

A further advantage of the method according to the invention and of the device consists in the possibility of lifting the workpiece out of the device after the forming process and releasing it for a workpiece transport system. This lifting-out is preferably effected by means of a gas spring. Other actuation mechanisms are also conceivable, for example the lifting-out of the formed workpiece can also be effected by means of hydraulic or pneumatic cylinders.

A further feature of the method according to the invention and of the device is that, during the forming process, the bottom die part is displaced downward by the top die part, via the punch, the rolling rod and the workpiece, against a force. This force in opposition to the forming motion can result, for example, from the lifting-out mechanism.

BRIEF DESCRIPTION OF THE DRAWINGS

Further details and advantages of the invention are disclosed by the exemplary embodiment represented in the figures.

DETAILED DESCRIPTION OF THE INVENTION

Figure 1:
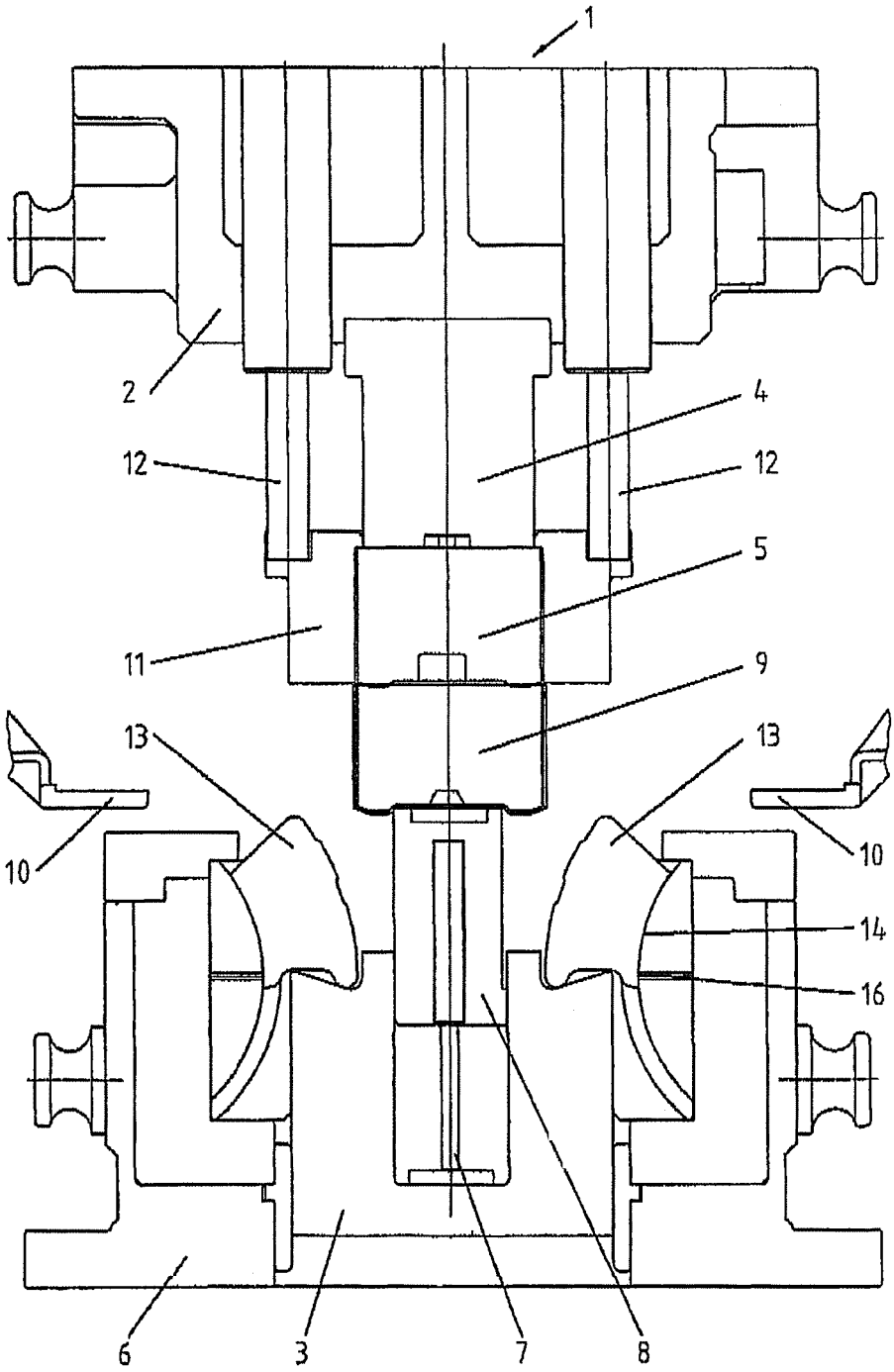
FIG. 1 shows a device after the insertion of a blank.

FIG. 1 shows a sectional representation of the device 1 according to the invention. The device 1 consists of a top die part 2 and a bottom die part 3. The punch 4, with the rolling rod 5, is fixedly connected to the top die part 2. The bottom die part 3 is mounted in a vertically movable manner in a cast housing 6. The bottom die part 3 is connected to a workpiece holder 8 via a gas spring 7. In the position represented, the workpiece 9, as a blank, has already been placed on the workpiece holder 8 by the grippers 10 of a workpiece transport system, which is not represented in greater detail here. The punch 4, with the rolling rod 5, is at the upper reversal position in which a driver 11 is spaced at a distance away from segmental discs 13. If the forming process then commences, the punch 4, with the rolling rod 5, moves downward, while the workpiece 9 likewise executes a downwardly directed vertical motion. The motion of the workpiece 9 is produced in that the workpiece holder 8, with the workpiece 9, is displaced downward against the force of the gas spring 7.

Figure 2:
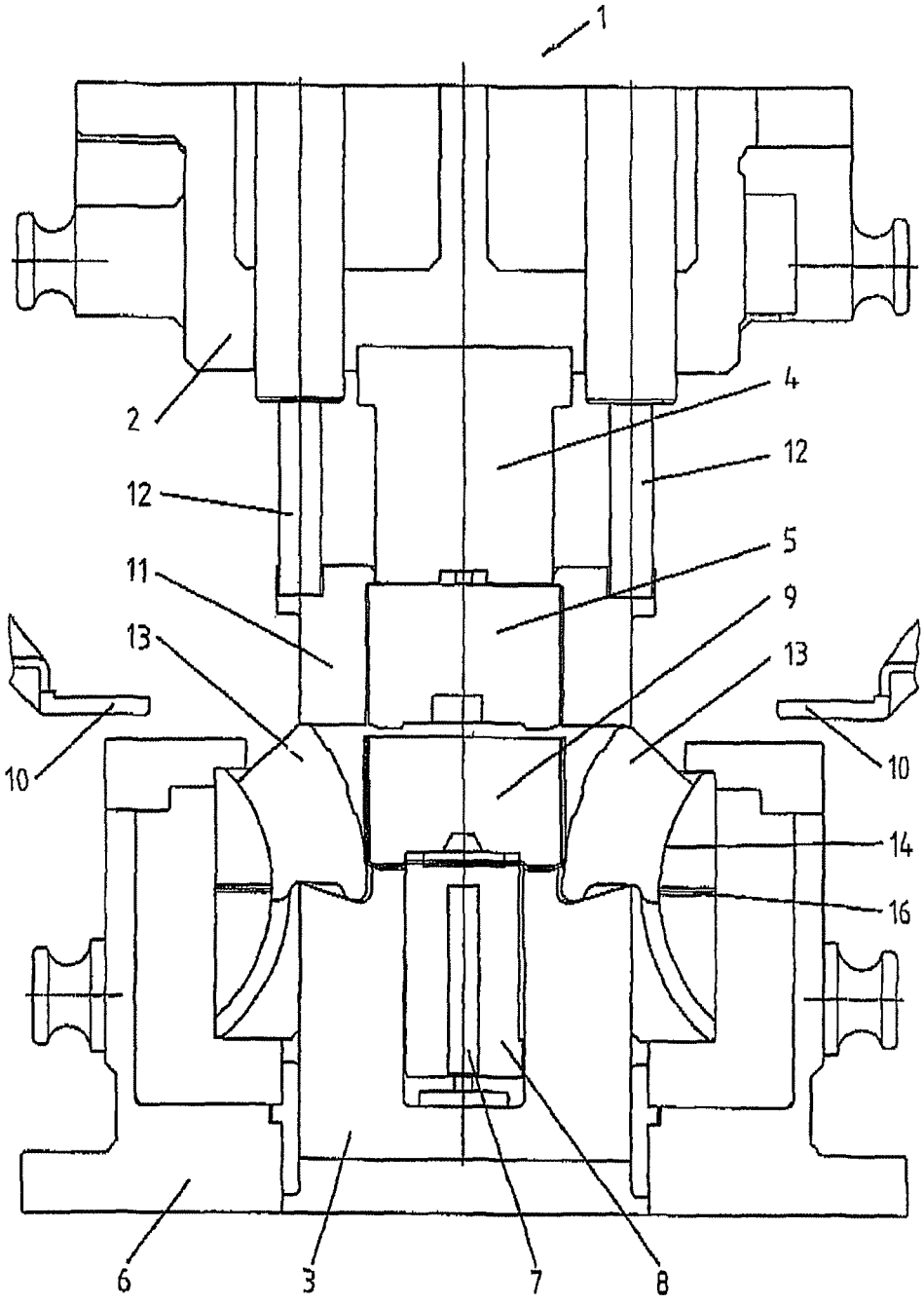
FIG. 2 shows a device at the start of forming.
Figure 3:
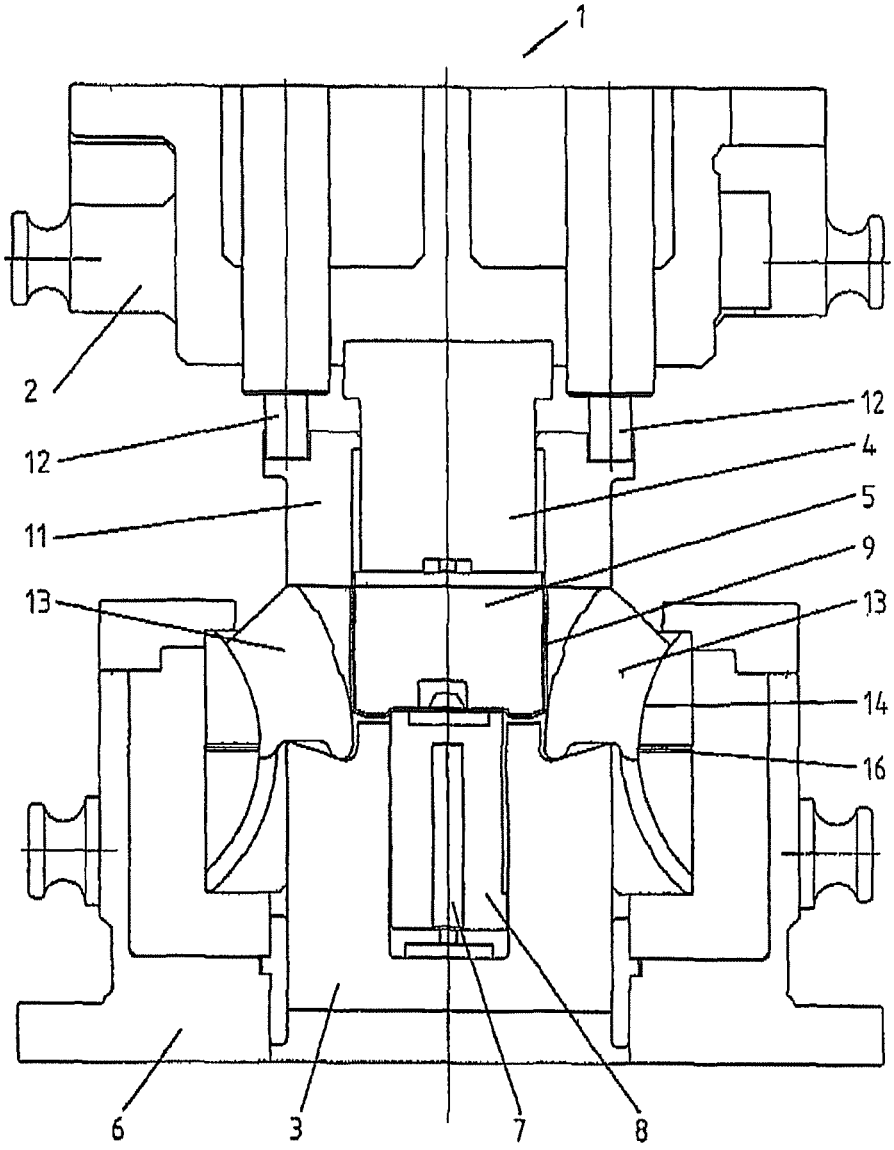
FIG. 3 shows a device at the end of forming.

In FIG. 2, the device 1 has reached a position in which the driver 11, which is connected to the top die part 2 via gas springs 12, reaches and contacts the upper contact surfaces of the segmental discs 13 only during the forming process. As a result, the lower contact surfaces of the segmental discs 13 then bear on the bottom die part 3. Because the driver 11 is bearing on the segmental discs 13, upon continuation of the downward motion of the punch 4, with the rolling rod 5, or of the top die part 2, the gas springs 12 retract to an extent at which the position represented in FIG. 3 is attained. The gas springs 12 are now retracted, the rolling rod 5 is located in the workpiece 9 and the segmental discs 13 are held in a precisely defined position, from above by the driver 11 and from beneath by the bottom die part 3. Starting from this position, the forming of the workpiece 9 by the segmental discs 13 commences upon a further downward motion of the punch 4.

Figure 5:
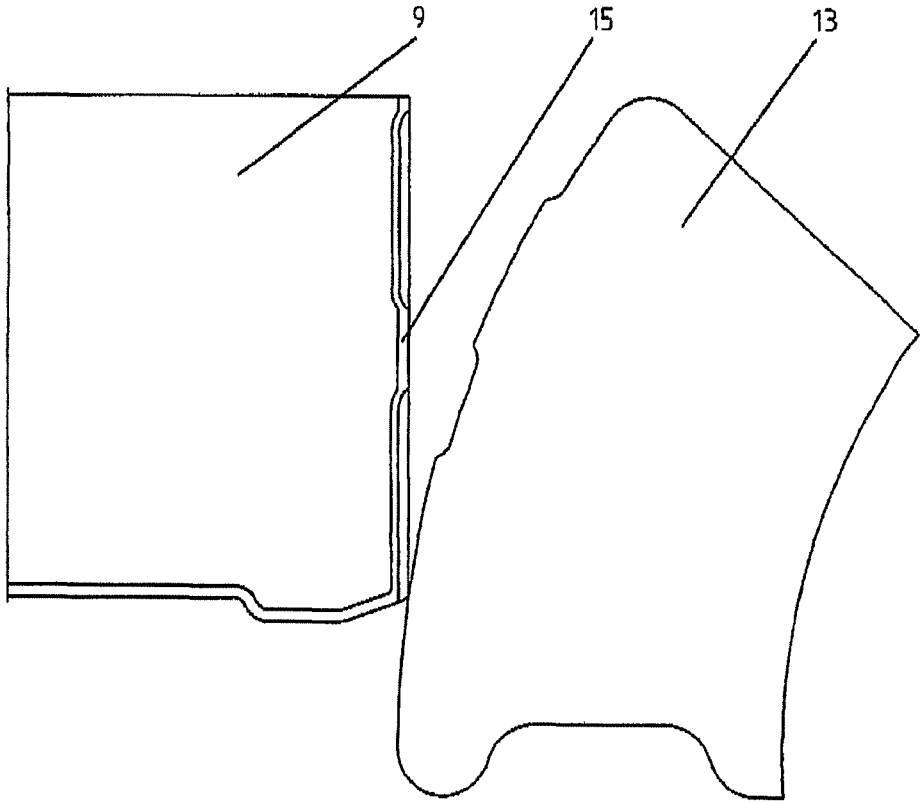
FIG. 5 shows an enlarged representation of the forming engagement during the forming process.

The positive connections of all moving components cause the segmental discs 13 to be moved downward in synchronism with the workpiece 9, relative to their vertical motion component. The rolling of the segmental discs 13 on the workpiece 9, which rolling is necessary for the forming process, is achieved in that the segmental discs 13 move along a curved stationary slide surface 14. This sliding guidance and the vertical drive by the driver 11, or by the bottom die part 3, cause the segmental discs 13 to move on a circular path, and thus enable them to roll exactly on the workpiece 9. The sides of the segmental discs 13 facing toward the workpiece 9 are provided with the negative form of the profile to be produced on the workpiece 9. In this exemplary embodiment, it is a profile having longitudinal grooves, which have a web 15 in the middle of the profile. This profile can be seen clearly in FIG. 5. In the position represented, the forming process has already been completed. The web 15 can be seen clearly in the middle of the profile. The form and, in particular, the position of this web 15 are subject to stringent quality requirements. Precise forming is possible only if, as in the device 1 according to the invention, there is a precisely defined starting position for the forming process that is independent of frictional ratios between segmental discs 13 and the workpiece 9 or of thickness tolerances of the workpiece 9.

Figure 4:
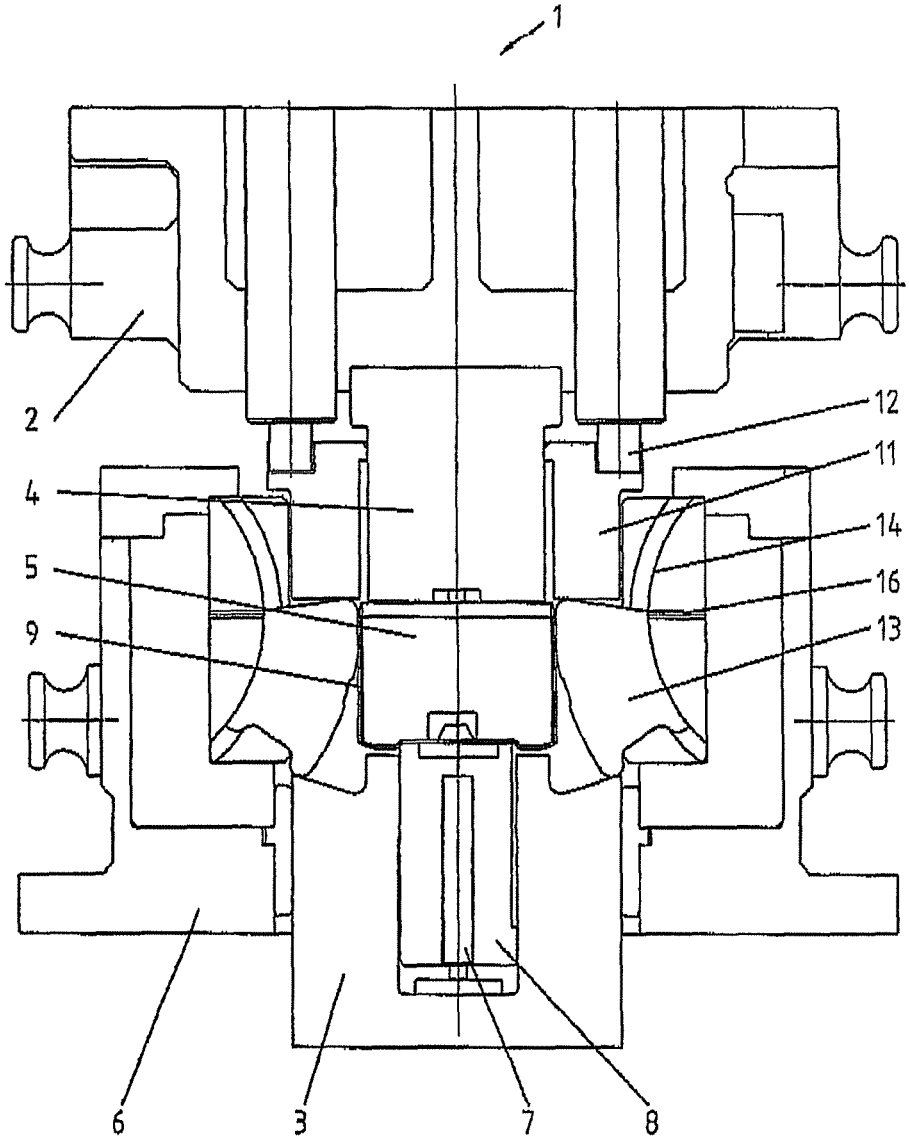
FIG. 4 shows a device after the workpiece has been lifted out.

FIG. 4 shows the position of the device 1 after the forming process. The segmental discs 13 have been pressed downward by the contact with the driver 11, and have thus rolled the profile onto the workpiece 9. The sliding motion of the segmental discs 13 on the slide surfaces 14 is rendered possible, or supported, by a pressure-feed lubrication, which is effected via the lubrication channel 16. The circular motion of the segmental discs 13 along the stationary slide surfaces 14 results in the occurrence of relative motions at the contact points between the driver 11 and the segmental discs 13, or between the bottom die part 3 and the segmental discs 13. The contact surfaces of the driver 11 and of the bottom die part 3 are therefore of such design that, at each instant during the forming process, the segmental discs 13 are held and guided both from above and from beneath. After completion of the forming process, the top die part 2 moves upward, with the punch 4 and the rolling rod 5. At the same time, the gas spring 7 extends and moves the workpiece holder 8, with the formed workpiece 9, upward in the same manner as the punch 5, until the position represented in FIG. 1 is attained. The workpiece 9 is now free, and can be gripped by the grippers 10 of the workpiece transport system and transported further.

The invention is not limited to the exemplary embodiment that is represented and explained. It also comprises all developments of persons skilled in the art, within the scope of the concept according to the invention.

LIST OF REFERENCES

1 Device
2 Top die part
3 Bottom die part
4 Punch
5 Rolling rod
6 Cast housing
7 Gas springs
8 Workpiece holder
9 Workpiece
10 Gripper
11 Driver

12 Gas spring
13 Segmental discs
14 Slide surface
15 Web
16 Lubrication channel

The invention claimed is:

1. A method for producing longitudinal grooves in a cylindrical workpiece, wherein a profile is formed on the circumference of the workpiece, said method comprising:

providing concentrically arranged profiled segmental discs arranged in a device;

arranging a drive spaced a distance away from the segmental discs; and moving the drive to make direct contact with the segmental discs only during each instant of the forming process, whereby the drive is independent of a rolling motion of the segmental discs on the workpiece.

2. The method as claimed in claim 1, wherein the drive of the segmental discs during the forming process is effected by a driving motion via contact surfaces on a punch or on components attached to the punch.

3. The method as claimed in claim 2, wherein the component attached to the punch is a driver.

4. The method as claimed in claim 1, wherein a reverse motion of the segmental discs is effected, after the forming process, via contact surfaces on a bottom die part; or on components that are attached to the bottom die part.

5. The method as claimed in claim 1, wherein each profiled segmental disc is held in a defined starting position for the forming process, by clamping on at least two contact surfaces respectively.

6. The method as claimed in claim 5, wherein the clamping is effected by means of a combined action of a downward motion of a top die part and of spring elements attached thereto.

7. The method as claimed in claim 1, wherein, during the entire forming process, a force that is in opposition to a forming motion acts upon the workpiece and acts as a holder for the workpiece.

8. The method as claimed in claim 7, wherein the force in opposition to the forming motion is produced by at least one gas spring.

9. The method as claimed in claim 1, wherein, after the forming process, the workpiece is lifted out of the device.

10. The method as claimed in claim 9, wherein the lifting-out motion is effected by means of at least one spring element, which produces a counter-force during the forming process.

11. A device for producing longitudinal grooves in a cylindrical workpiece, comprising:

concentrically arranged profiled segmental discs;

stationary slide surfaces for displaceably supporting each segmental disc, respectively;

a punch that moves in a formation direction, the punch being arranged to make contact with the segmental discs either directly or through components attached to the punch; and a bottom die part that moves in the formation direction, the bottom die part being arranged to make contact with the segmental discs either directly or through components attached to the moving bottom die, wherein during a forming process the segmental discs move in the formation direction relative to the stationary slide surfaces to form a profile on the circumference of the workpiece.

12. The device as claimed in claim 11, wherein the components attached to the bottom die part are in contact with the profiled segmental discs via contact surfaces on which sliding relative motions are made possible.

13. The device as claimed in claim 12, further comprising a pressure-feed lubrication provided between the contact surfaces and the segmental discs.

14. The device as claimed in claim 11, further comprising at least one driver is connected to a top die part via spring elements, wherein said driver holds the profiled segmental discs in a defined position through a downward motion of the top die part before the forming process.

15. The device as claimed in claim 11, wherein the workpiece is moved past the segmental discs by a downward motion of a top die part, by means of a punch and a rolling rod, by which there is thereby produced on the workpiece a profile that corresponds to the outer contour of the segmental discs.

16. The device as claimed in claim 11, wherein, during the forming process, a top die part is displaced downward with a holder for the workpiece.

17. The device as claimed in claim 11, wherein, after the forming process, the workpiece is lifted out of the device by means of at least one spring element and a holder for the workpiece.

18. The device as claimed in claim 17, wherein the spring element is a gas spring.

* * * * *